US007363871B2

(12) United States Patent
Hudd

(10) Patent No.: US 7,363,871 B2
(45) Date of Patent: Apr. 29, 2008

(54) APPARATUS FOR CLEANING THE HULL OF A FLOATING VESSEL

(75) Inventor: Adrian Gerald Hudd, Isle of Wight (GB)

(73) Assignee: Lone Oak Investments Limited, Kent (GB)

( * ) Notice: Subject to any disclaimer, the term of this patent is extended or adjusted under 35 U.S.C. 154(b) by 32 days.

(21) Appl. No.: 11/248,925

(22) Filed: Oct. 11, 2005

(65) Prior Publication Data

US 2007/0051291 A1 Mar. 8, 2007

(30) Foreign Application Priority Data

Sep. 8, 2005 (GB) ..... 0518350.4

(51) Int. Cl.
*B63B 59/08* (2006.01)

(52) U.S. Cl. ..... 114/222

(58) Field of Classification Search ..... 114/222, 114/230.22

See application file for complete search history.

(56) References Cited

U.S. PATENT DOCUMENTS 1,221,012 A * 4/1917 Anderson ..... 114/230.22
3,404,653 A * 10/1968 Sierra et al. ..... 114/222
3,946,692 A * 3/1976 Sierra et al. ..... 114/222
4,046,095 A 9/1977 Fike
4,445,451 A * 5/1984 van den Broek ..... 114/222
2007/0079743 A1* 4/2007 Hudd et al. ..... 114/222

FOREIGN PATENT DOCUMENTS

DE 4426988 A1 3/1995
WO WO 01/02243 * 1/2001

* cited by examiner

*Primary Examiner*—Sherman Basinger
(74) *Attorney, Agent, or Firm*—Barnes & Thornburg LLP

(57) ABSTRACT

Improvements to a cleaning assembly include a support for a rotating object, a rotary brush, an apparatus for manoeuvring a floating vessel and an arm arrangement for cleaning a surface. Thus, an inventive cleaning assembly is provided, the cleaning assembly comprising a submersible framework, and two arms of the aforementioned arrangement pivoted to the submersible framework at the opposite end of the arm to the brush and gimbal arrangement, the arms having a substantially horizontal rest position and pivoted to allow the arms to move to move the brush to clean both sides of a floating vessel.

15 Claims, 15 Drawing Sheets

*Fig. 1* *(PRIOR ART)*

APPARATUS FOR CLEANING THE HULL OF A FLOATING VESSEL

FIELD OF THE INVENTION

The invention relates to improvements in apparatus for cleaning the hull of a floating vessel, and more particularly to a support for a rotating object, a rotary brush, an apparatus for manoeuvring a floating vessel, an arm arrangement for cleaning a surface and a cleaning assembly.

RELATED ART

It is common practice for power and sailing craft to be cleaned at least twice a year, which can increase performance and fuel economy significantly. Such cleaning is assisted by anti-fouling paints. However, anti-fouling paints are becoming increasingly expensive and, because of worldwide anti-pollution laws, the paints available to both the commercial and leisure industries are becoming less effective.

FIGS. 1 and 2 show a plan view and side elevation, respectively, of a boat cleaning assembly proposed by the applicant in EP 1,196,321. Referring to FIGS. 1 and 2, the cleaning assembly 1 comprises a pair of pivotable arms 3 and 4 which are each provided at their free ends with a rotatably mounted brush 5 and 6 respectively. The arms are pivotable about an axis A-A on an axle 15 which is mounted on a base framework 18, the arms being pivotable about axis A-A by means of an upright hydraulic ram 17*a* and a tie rod 17*b* which is connected to the ram 17*a*.

With reference in particular to FIG. 1, the arms 3 and 4 each comprise a central portion 27, 26 and two inwardly directed portions, 7 and 11, and 8 and 12 respectively.

On each of the arm portions 7 and 8 there is rotatably mounted on gimbals 9 and 10 a brush 5 and 6, respectively. The gimbals provide free suspension in all planes for the respective brush. Each brush 5 and 6 comprises bristles provided on a front flat circular surface 30 and on a tapered outer surface 31. Each arm 3 and 4 is pivotally mounted for generally lateral movement about pivots 21 and 20 in arcs C and D respectively.

The assembly 1 further comprises arm mounting means 19. Hydraulic cylinder assemblies 13 and 14 are provided which are pivotally attached at one end to the arm portions 11 and 12 and at the opposite end to a bracket 35, the bracket 35 being secured between the free ends of the mounting means 19. The mounting means 19 are fixedly secured to the axle 15, the pivots for said axle being provided on two upstanding brackets 36 and 37 which are attached to the base framework 18.

An operating arm 22 is attached at one end to the axle 15 and at its other end to the lower end of the tie rod 17*b*. A ram 17*a* and the tie rod 17*b* are enclosed by an upright framework 16 which comprises two opposing upright members 25 and a plurality of horizontal bridges 24.

The assembly is submerged in a suitable region of water and the base framework 18 rests on the seabed. A marine vessel, for example a yacht (not shown), is then manoeuvred so that the vessel is positioned above the arms 3 and 4. A winch configuration (not shown) is then attached to a stem line and a bow line of the vessel so that the vessel may be conveyed across the axis A-A.

The tie rod 17*b* is then actuated so that the arms 3 and 4 are pivoted upwardly about horizontal axis A-A towards the surface of the water. On reaching the surface of the water, a signal is sent to memory means of the assembly control means so that the vertical position of the tie rod 17*b*, which corresponds to the arms being at the waterline, is stored. Position sensing means are then operative to monitor the vertical position of the tie rod 17*b*. Using the control means, which comprises a console, a user then activates the hydraulic brush drive means so as to rotate the brushes 5 and 6. Hydraulic drive means associated with the hydraulic cylinder devices 13 and 14 is then activated so as to urge the arms 3 and 4 towards the hull of the vessel. Sensing means are provided which is operative to monitor the back pressure of the hydraulic fluid used to actuate the brushes.

Once a predetermined pressure value has been reached, such that fouling is removed with the minimum of any hull paint, the cleaning operation is commenced and in so doing the hydraulic ram 17*a* causes the arms 3 and 4 to pivot downwardly about axis A-A. The correct pressure applied to the fouling on the hull is maintained as the arms pivot about pivots 21 and 20 to follow the curved profile of the hull. The pivots 21 and 20 allow for displacement of the arms 3 and 4 which is generally lateral of the longitudinal axis the hull of the vessel.

As the arms sweep downwards through arc B, the rotating brushes eventually meet underneath the hull. When the brushes come into rotational contact with each other, the control means controls the hydraulic cylinder assemblies 13 and 14 to urge the arms 3 and 4 apart and generally outwardly of the hull. The control means then causes the winch means to be activated to convey the vessel a predetermined distance perpendicular to the axis A-A. Whilst the brushes are still apart, the arms are then pivoted generally upwardly of the hull through a predetermined angle by axle 15 and then towards the hull to contact with any fouling thereon. Once the predetermined value of back pressure of the hydraulic brush drive means is attained, the brushes are pivoted generally upwardly of the hull.

Once the tie rod 17*b* reaches the predetermined position corresponding to that angular position of the arms 3 and 4 at which the brushes are at water level, the arms 3 and 4 are urged laterally outwardly of the hull so that the brushes are no longer in contact therewith. The vessel is then moved forward the predetermined distance by the winch means. The arms are then urged laterally inwardly of the hull so that the brushes come into contact with the fouling with the required pressure. The brushes are then caused to sweep generally downwardly of the hull. The cleaning process continues in the same fashion until the whole length of the hull has been subjected to the brushes, at which point the winch means will have conveyed the vessel clear of the paths of the brushes.

Use of the above boat cleaning assembly proposed by the applicant has demonstrated that it exhibits a number of problems and, consequently, it does not provide for optimal cleaning. It is therefore desirable to realise an improved boat cleaning assembly

SUMMARY OF INVENTION

According to an aspect of the invention, there is provided an arm arrangement for cleaning a surface, comprising: an arm; a brush and gimbal arrangement on the end of the arm, the brush and gimbal arrangement including: a brush; a drive means for rotating the brush about a first axis; pivots to allow the brush and drive means to rotate about a second axis substantially perpendicular to the first axis and a third axis substantially perpendicular to the first axis and to the second axis to allow the brush to pivot on the end of the arm to follow the surface for cleaning.

According to another aspect of the invention, there is provided a cleaning assembly, comprising: a submersible framework; means for mounting the submersible framework to a fixed body; and two arm arrangements according to any preceding claim, each arm being pivoted to the submersible framework at the opposite end of the arm to the brush and gimbal arrangement, the arms being pivoted to allow the arms to move to move the brush to clean both sides of a floating vessel, arranged such that when the assembly is mounted the arms have a substantially horizontal rest position.

According to yet another aspect of the invention, there is provided a support for a rotating object, the object rotating about a first axis, wherein the support comprises: a drive means for rotating the object about the first axis; a gimbal arrangement for supporting the drive means and the object, the gimbal arrangement having pivots to allow the drive means and object to rotate about a second axis substantially perpendicular to the first axis and a third axis substantially perpendicular to the first axis and to the second axis, and a pivot to allow the object to rotate about a fourth axis substantially parallel to the second axis and spaced from the second axis.

According to a further aspect of the invention, there is provided a support for a rotary brush comprising: a surface that rotates about an axis; and a plurality of bristle clumps attached to the surface, the bristle clumps being arranged in rows extending radially from the first axis.

According to a yet further aspect of the invention, there is provided an apparatus for manoeuvring a floating vessel forward and aft in the longitudinal direction comprising: bidirectional drive means having a plurality of longitudinally spaced drive positions; and attachment means adapted to attach a plurality of different places on the boat to respective drive positions, wherein the bidirectional drive means is arranged to drive the plurality of longitudinally spaced drive positions together to move the boat fore and aft.

BRIEF DESCRIPTION OF DRAWINGS

For a better understanding of the invention, embodiments will now be described, purely by way of example, with reference to the accompanying drawings, in which.

Like reference numerals refer to like elements throughout.

DETAILED DESCRIPTION

Figure 1:
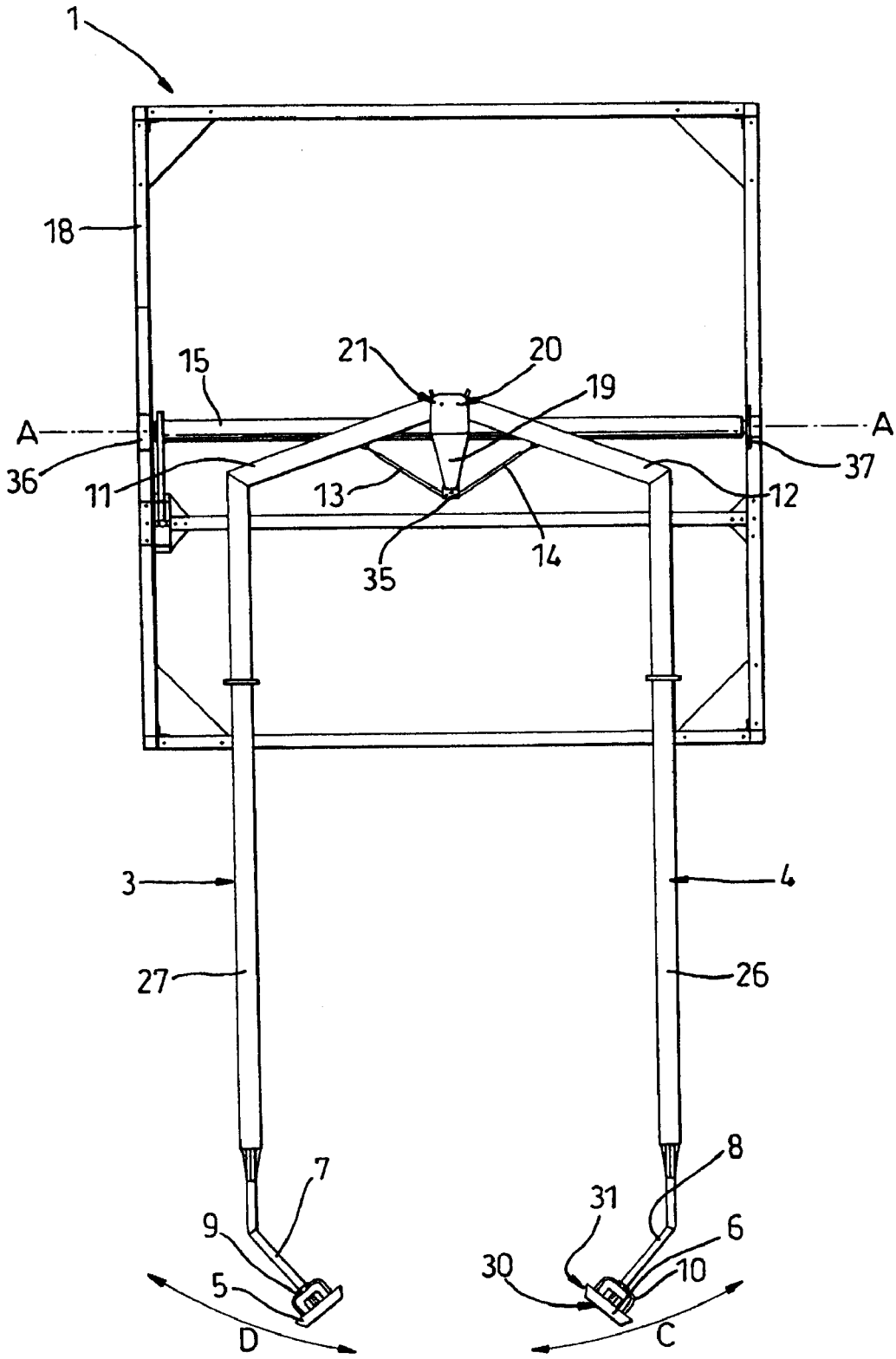
FIG. 1 shows a plan view of an existing boat cleaning assembly.
Figure 2:
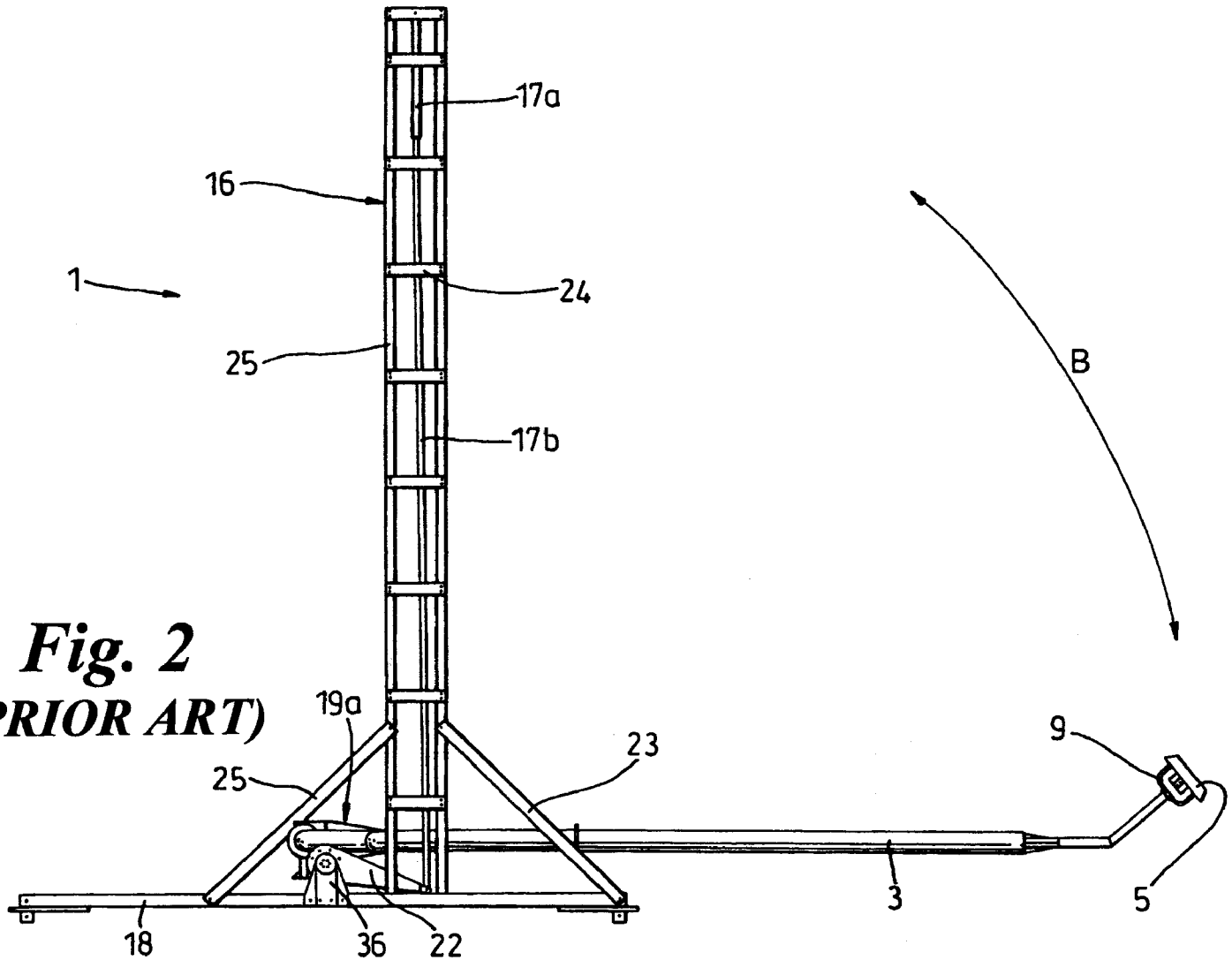
Fig. 2 (PRIOR ART)
FIG. 2 shows a side elevation of an existing boat cleaning assembly.

The embodiment described is a boat cleaning assembly. The overall assembly is similar to that as shown in FIGS. 1 and 2. However, various components of the assembly are improved compared with the boat cleaning assembly of FIGS. 1 and 2 with the result that the overall assembly gives an improved performance.

Figure 3:
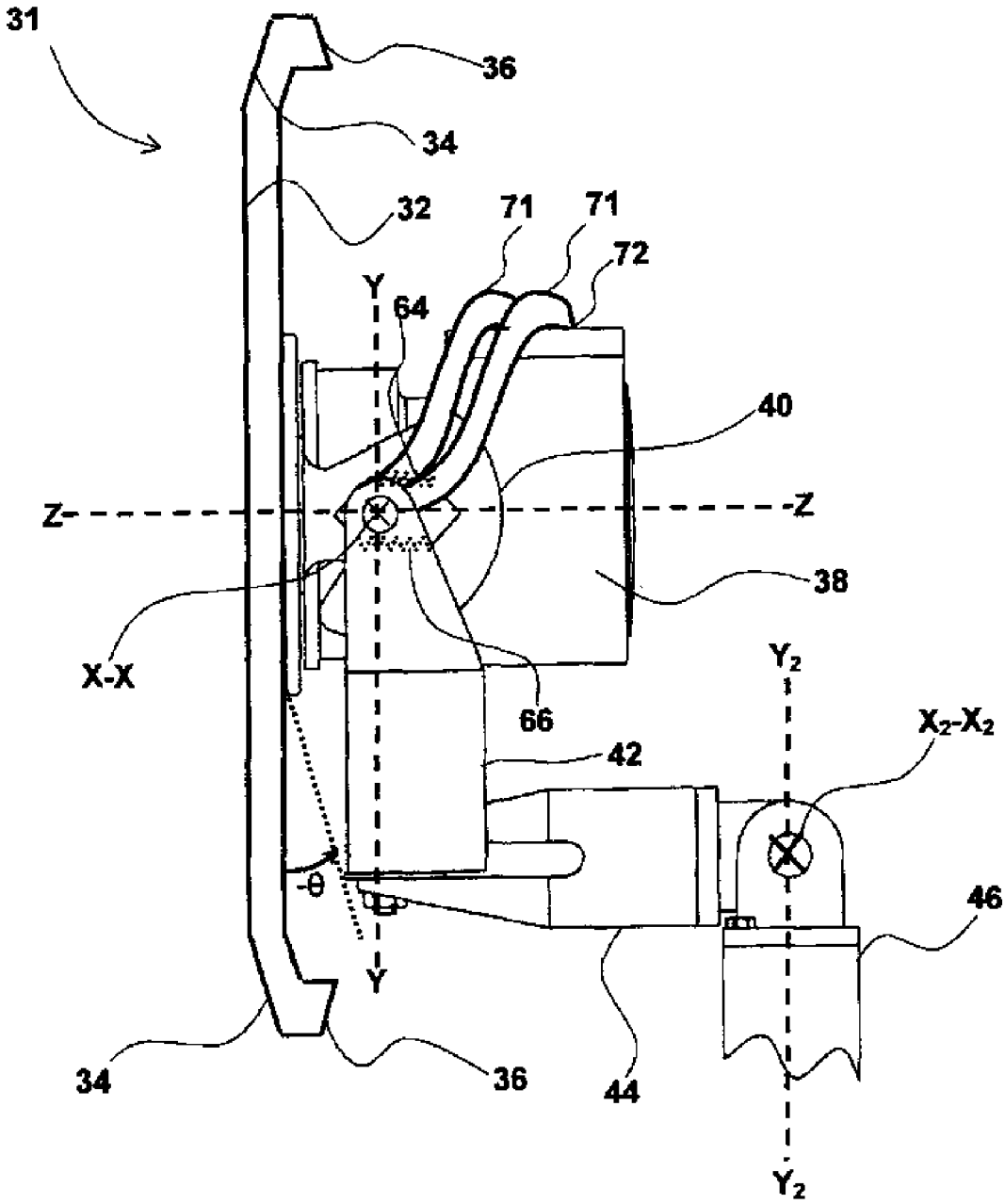
FIG. 3 is a side elevation of a brush and gimbal arrangement according to an embodiment of the invention.
Figure 4:
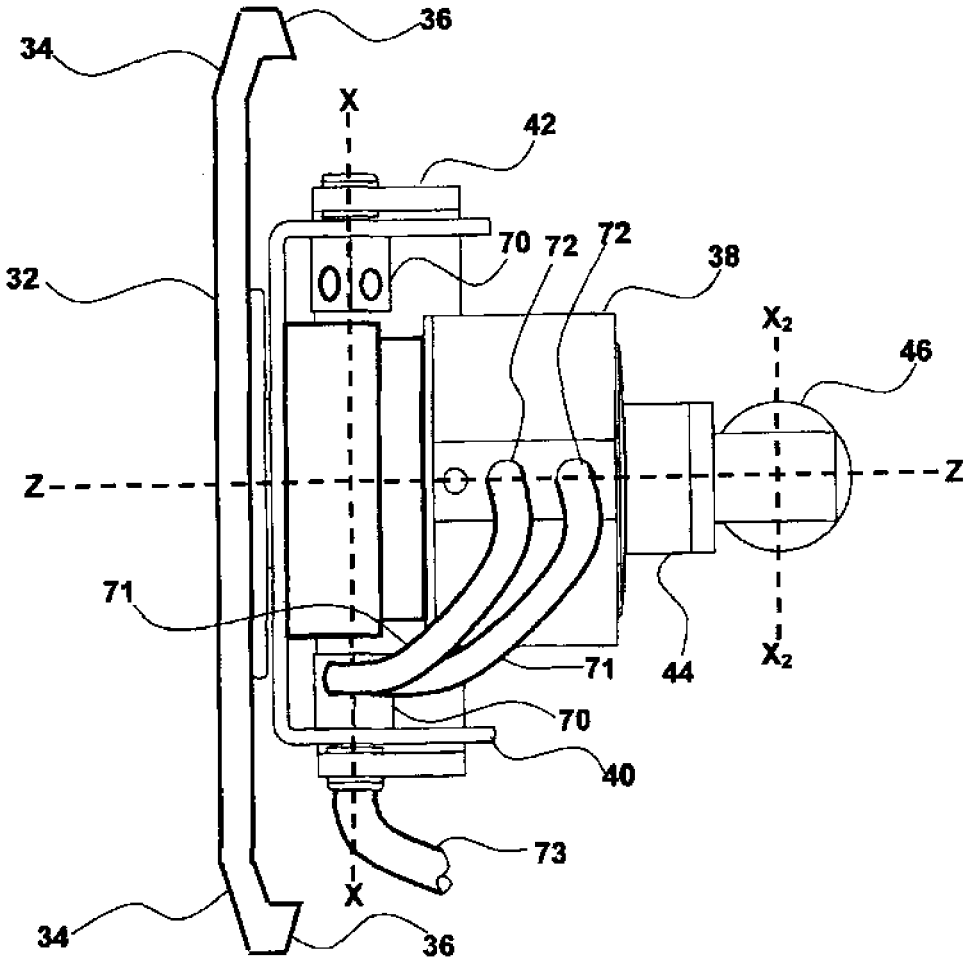
FIG. 4 shows a plan view of a brush and gimbal arrangement of FIG. 3.

A first improvement relates to the way in which the brush is mounted on gimballed bearings. The mounting used in the embodiment will be described first, and then the reasons for using the mounting will be discussed. Referring to FIG. 3, a side elevation of a brush and gimbal arrangement according to an embodiment of the invention is shown. FIG. 4 shows a top view of the same arrangement.

The brush 31 comprises bristles (not shown) provided on a flat front circular surface 32, on a tapered outer front surface 34, and on a tapered outer rear surface 36. The brush 31 is rotatably connected to motorised drive means 38, the drive means 38 being operative to rotate the brush 31 about a Z-axis Z-Z on an axle (not shown).

The brush 31 and drive means 38 are supported by a first mounting bracket 40 which is rotatably connected to a second mounting bracket 42. The first and second mounting brackets 40 and 42 cooperate such that the brush 31 and drive means 38 are free to rotate about an X-axis (indicated by X-X) on bearings.

The second mounting bracket 42 is rotatably connected and supported by a first arm portion 44 such that the second mounting bracket 42 is free to rotate about a Y-axis Y-Y on a bearing (not shown).

The first arm portion 44 is rotatably connected to a second arm portion 46 such that the first arm portion 44 may be rotated about an $X_2$-axis $X_2$-$X_2$, the $X_2$-axis $X_2$-$X_2$ being substantially in the same direction as the X-axis X-X. The second arm portion 46 is also rotatably connected to displacement means (not shown) of a cleaning assembly (for example, arm 3 or 4 of the assembly shown in FIGS. 1 and 2) such that the second arm portion 46 may be rotated about a $Y_2$-axis $Y_2$-$Y_2$, the $Y_2$-axis $Y_2$-$Y_2$ being substantially in the same direction as the Y-axis Y-Y.

The brush is arranged to freely rotate about the X and Y axes according to external forces applied to the brush, whereas rotational motion of the brush about the $X_2$ and $Y_2$ axes is powered by drive means, the drive means being arranged such that the motion of the brush about the $X_2$ and $Y_2$ is programmable or controllable.

Thus, the rotation about the X-and Y-axes ensures that the face of the brush is against the boat during cleaning, and the brush 31 can be moved along the boat using the rotations about the $X_2$ and $Y_2$ axes.

Figure 5:
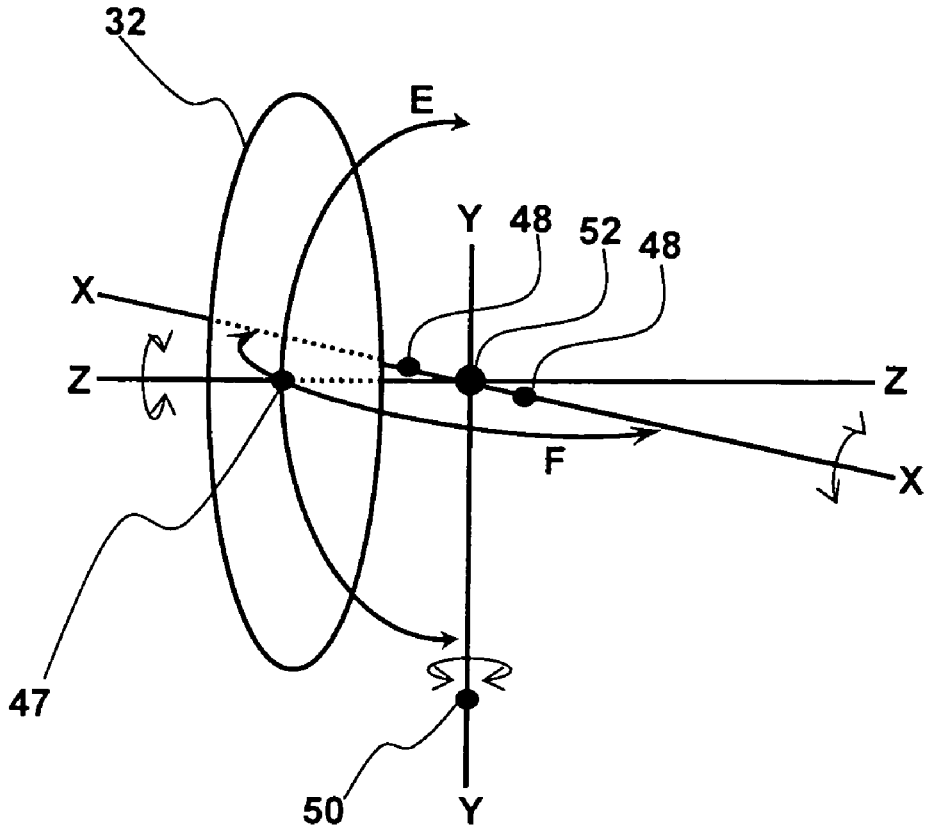
FIG. 5 is an illustration of the relationship between the axes of rotation and pivot points for the brush and gimbal arrangement the arrangement of FIGS. 3 and 4.

The brush and gimbal arrangement of FIG. 3 will now be further explained with reference to FIG. 5. FIG. 5 is an illustration of the relationship between the axes of rotation and pivot points for the arrangement of FIGS. 3 and 4. To assist understanding of the illustration, the relative location of the flat front circular surface 32 of the brush is indicated in the illustration.

The flat front circular surface 32 of the brush is rotatable about the Z-axis Z-Z on pivot 47, the brush 31 and drive means 38 are rotatable about the X-axis on bearings 48, and the second mounting bracket 42 is rotatable about a Y-axis Y-Y on bearing 50. The axes, X, Y and Z are substantially orthogonal and are shown intersecting at a point 52 which is rather centrally located inside brush and drive means 38.

Rotation of the brush 31 and drive means 38 about the X-axis generates movement of the surface 32 of the brush generally along arc E. Similarly, rotation of the second mounting bracket 42 about the Y-axis generates movement of the surface 32 of the brush generally along arc F.

It is to be appreciated that, in the illustration, the relative distances between the bearings 48, 50 and the surface 32 of the brush are not to scale, being arranged solely for the purpose of clarity. It can be appreciated these distances affect the shape of the illustrated arcs E and F.

When then the flat front circular surface 32 of the brush is parallel to the X-Y plane, as illustrated in FIGS. 3, 4 and 5, the brush 31 is said to be in its reference position with zero angular displacement along the arcs E and F. When in this reference position, the front circular surface 32 of the brush may also be said to be in the reference plane. Thus, the example of the present invention is arranged such that the reference plane is parallel to the X-Y plane.

Referring back to FIG. 3, it can be appreciated that the range of angular displacement of the brush and drive means about the X-axis X-X is limited to an angle $-\theta$ in a counter-clockwise direction, due to the proximity of the second mounting bracket 42 to the back of the flat brush face 32.

Figure 6:
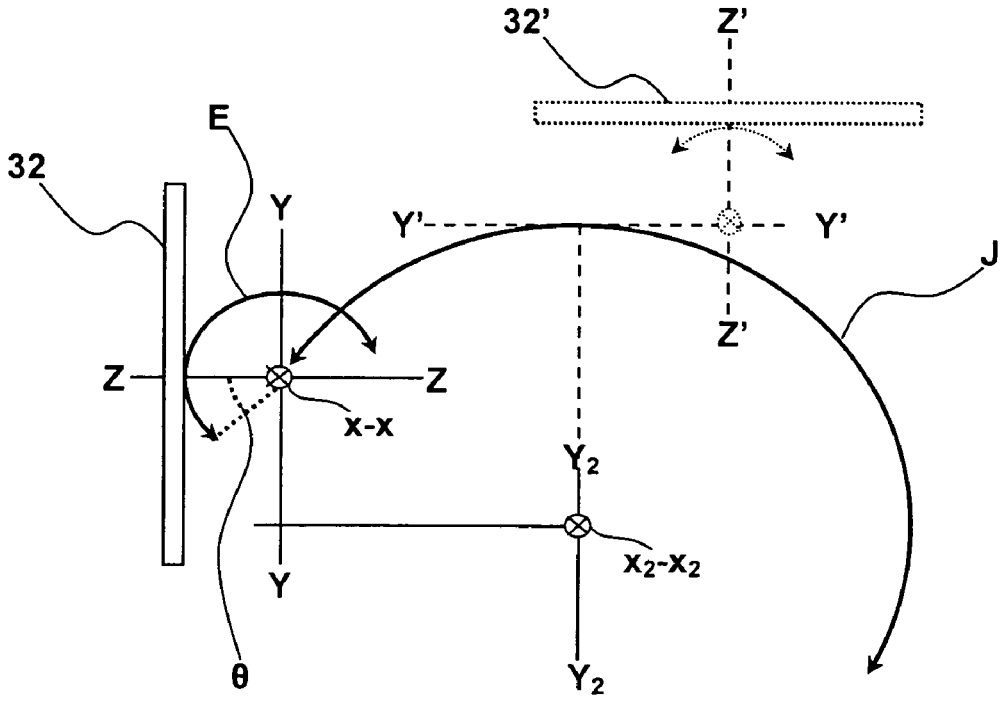
FIG. 6 illustrates how the gimbal arrangement of FIG. 3 permits motion of a rotary brush.

FIG. 6 illustrates how the gimbal arrangement of FIG. 3 permits motion of the rotary brush 32. As may be seen, the first arm portion 44 may be rotated about the $X_2$-axis with respect to the second arm portion 46 to move the second mounting bracket 42 generally along arc J. Rotation by 90° results in the position illustrated by the dashed lines indicating the position of the surface of the brush 32' (and the Z' and Y' axes). Similarly, rotation of the second arm portion 46 about the $Y_2$-axis $Y_2$-$Y_2$ generates movement (not shown) of the surface 32 of the brush about the $Y_2$-axis $Y_2$-$Y_2$. It can therefore be appreciated that the allowable range of displacement of the surface 32 of the brush about the $X_2$ and $Y_2$ axes forms a semi-spherical surface.

Rotation of the first mounting bracket 40, and hence the brush 31, about the X-axis X-X with respect to the second mounting bracket 42 generates movement of the surface 32 of the brush generally along arc E, as shown in FIG. 5 and FIG. 6.

Similarly, rotation of the second mounting bracket 42 about the Y-axis Y-Y generates movement (illustrated by arc F in FIG. 5) of the surface 32 of the brush about the Y-axis Y-Y. Thus, the surface of the brush may be moved with a great deal of flexibility.

This enables the surface 32 of the brush to maintain contact with a curved or uneven surface to be cleaned. Minor variations in the shape or movement of the surface to be cleaned, for example a small movements of a boat hull due to wave motion, are accounted for by pivotal motion of the brush surface 32 about the X and Y axes. Larger variations in the shape or movement of the surface to be cleaned may also be accounted for by pivotal motion of the brush surface 32 about the $X_2$ and $Y_2$ axes.

Figure 7A:
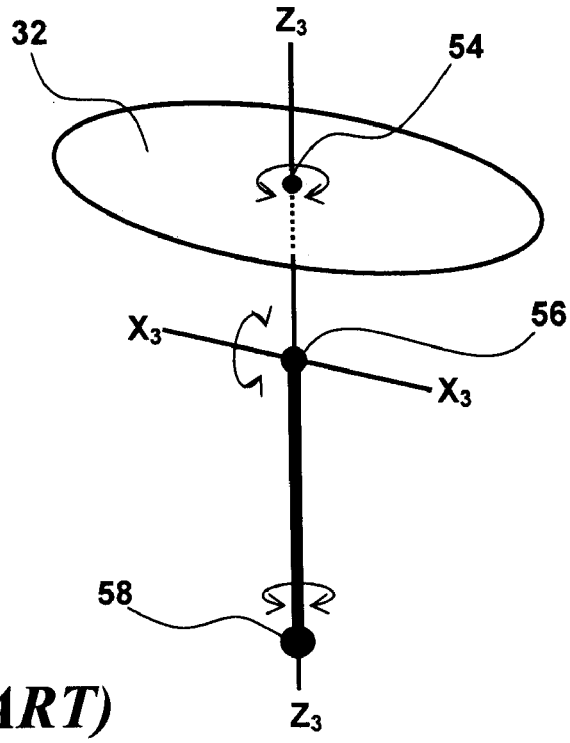
Fig 7a (PRIOR ART)
FIGS. 7*a* and 7*b* illustrate the motion provided by the brush mountings in the boat cleaning assembly shown in FIGS. 1 and 2.
Figure 7B:
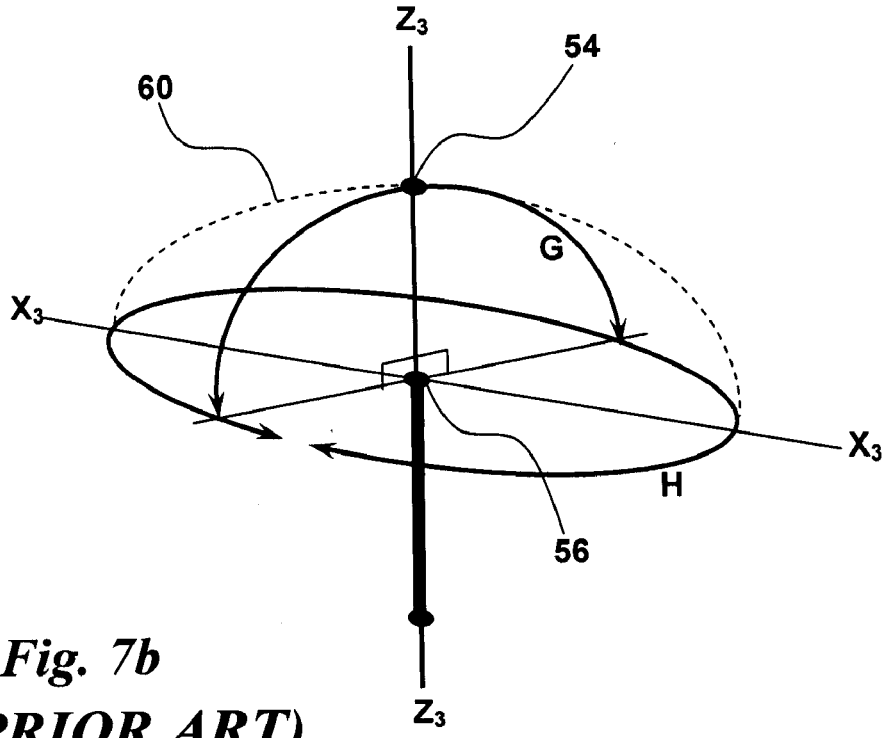
Fig. 7b (PRIOR ART)

FIGS. 7*a* and 7*b* illustrate the motion provided by the brush mountings in the boat cleaning assembly shown in FIGS. 1 and 2 by way of comparison.

The flat front circular surface 32 of the brush is rotatable about the $Z_3$-axis $Z_3$-$Z_3$ on pivot 54. This is in turn mounted on bearing 56 to allow the brush and drive means 38 to be rotatable about the $X_3$-axis $X_3$-$X_3$. This bearing is mounted on arm portion 57 linking to a second bearing 58 which permits the arm portion to rotate about the $Z_3$-axis $Z_3$-$Z_3$.

Rotation of the brush and drive means 38 about the $X_3$-axis generates movement of the surface 32 of the brush generally along arc G. Similarly, rotation of the arm portion about the $Z_3$-axis $Z_3$-$Z_3$ generates movement of the surface of the brush generally along arc H.

Referring in particular to FIG. 7*b*, it can be appreciated the allowable range of angular displacement of the surface 32 of the brush about the $X_3$-axis $X_3$-$X_3$ is limited to an angle of $-\pi/2$ radians in a counter-clockwise direction and an angle of $\pi/2$ radians in a clockwise direction. Thus, the allowable range of displacement of the surface 32 of the brush forms a semi-spherical surface, indicated generally by 60.

Now, when the motor is operated with the axis of rotation of the motor parallel with the axis of rotation of the arm portion 57 with respect to the second bearing 58, the rotation of the motor causes forces to be exerted on the brush with the brush against the ship. It might be thought that this would simply cause rotation of the arm 57 about the bearing. However, in fact the inventors have realised that instead the brush tends to pivot about the X-axis at bearing 56. This causes great difficulty in keeping the brush against the sides of the boat. These twisting forces are amplified when the brush is rotating and the surface of the brush bridges two different environments, for example air and water. Consequently, the cleaning action of the rotating brushes is unpredictable and sub-optimal. The effect of these forces will be hereinafter referred to as a gyroscopic effect, since the direction of the twisting forces is the same.

Referring back to FIGS. 3 to 6, the brush and gimbal arrangement according to the embodiment avoids this difficulty. Referring to FIG. 6, it may be seen that in both the initial and final positions the brush rotates about an axis perpendicular to the X-X and Y-Y axes. In this way the reference plane of the flat front circular surface 32 of the brush is parallel to the X-Y plane, the gimbal arrangement provides free suspension for the brush in all planes while also minimising unwanted forces resultant from the gyroscopic effect.

A disadvantage is that the allowable angular displacement $-\theta$ in the arrangement of FIG. 3 is less than that of the allowable angular displacement $-\pi/2$ radians in the arrangement of FIG. 7. Put more simply, $|\theta|<|\pi/2|$. This is a direct consequence of arranging the reference plane of the flat front circular surface 32 of the brush such that it is parallel to the X-Y plane. In other words, arranging the pivot of the Y-axis vertically below the pivot of the X-axis (when referring the illustration of FIG. 3) introduces the second support bracket 42, which ultimately limits the allowable range of angular displacement θ of the brush and drive means about the X-axis X-X in a counter-clockwise direction.

For this reason, the brush according to the embodiment is not merely provided with two gimbal axes X-X and Y-Y but additional gimbal axes $X_2$ and $Y_2$ are provided. As detailed above, the first arm portion 44 may be rotated about the $X_2$-axis $X_2$-$X_2$ (the $X_2$-axis $X_2$-$X_2$ being substantially in the same direction as the X-axis X-X), and the second arm portion 46 may be rotated about a $Y_2$-axis $Y_2$-$Y_2$ (the $Y_2$-axis $Y_2$-$Y_2$ being substantially in the same direction as the Y-axis Y-Y) in the reference position.

Referring back to FIG. 6, it will be noted that in the position shown by the dotted lines the Z' axis is in fact parallel to the $Y_2$ axis. However, since the first arm 44 is not free to rotate about the $Y_2$ axis, but this is controlled, this does not cause the front face of the brush 32 to twist away from the hull.

The arrangement gives great flexibility of motion which is useful in particular for cleaning boats with a flat or substantially flat bottom.

Returning to FIGS. 3 and 4, the inventors have realised that further improvement in the performance of the cleaning assembly can be achieved by balancing the brush and the motor. Any imbalance will result in the brush and drive means 38 experiencing a net turning force about the X-axis.

The necessary adjustability is provided by first mounting bracket 40 comprising two sets of teeth 64, 66 opposite each other, each set of teeth 64, 66 comprising a plurality of teeth longitudinally spaced along the direction of Z-axis Z-Z in a periodic arrangement. A bearing (not shown) supported by the second mounting bracket 42 is operatively connected to the sets of teeth 64, 66 on the first mounting bracket 40. The position of the bearing and hence the second mounting bracket can be adjusted by moving the bearing along the Z axis to be supported by different teeth. The bearing and sets of teeth 64, 66 cooperate to support the first mounting bracket 40 and to locate it at discrete positions about the pivot point of the X-axis X-X with respect to the second mounting bracket 42.

Thus, the position of the first mounting bracket 40 with respect to the second mounting bracket 42 can be adjusted longitudinally of the Z-axis Z-Z to balance the brush and drive means on either side of the X-axis, ensuring that the moment exerted by gravity of the brush balances the moment of the drive means 38.

It is typically necessary to provide connections to the brush or drive means, for example wire, a hydraulic hosing or a pneumatic hosing attached to the brush to deliver power, forced water or compressed air to the brush. Such connections can unbalance the brush and drive means. As detailed above, when allowing for the brush and drive means 38 to freely rotate about the X-axis X-X, it may be desirable to minimise or remove any unbalancing effect about the X-axis X-X which may be caused by such attachments.

To this end, rotary connectors 70 (FIG. 4) are supported by the second mounting bracket 42 and operatively connected to the first mounting bracket 40 such that the brush and drive means 38 are free to rotate about the X-axis X-X on the bearing of the each connector 70.

Importantly, the rotary connectors 70 in this embodiment are arranged such that all three of the connection ports of the three-way connector are on inside of the first mounting bracket 40, i.e. on the side that faces inward towards the brush drive means 38. Attachments such as wire, hydraulic hosing or pneumatic hosing are connected between the ports of the three-way connector and the respective ports on the drive means 38.

Such connections are internal to the volume defined by the extremities of the first and second mounting brackets 40, 42 (for ease of reference, such connections are hereinafter referred to as internal connections) and rotate about the X-axis X-X with the brush and drive means 38. Thus, it is to be appreciated that the orientation of the additional attachments with respect to the brush and drive means 38 remains fixed and can therefore be accounted for when balancing forces about the X-axis X-X using teeth 64.

Figure 8A:
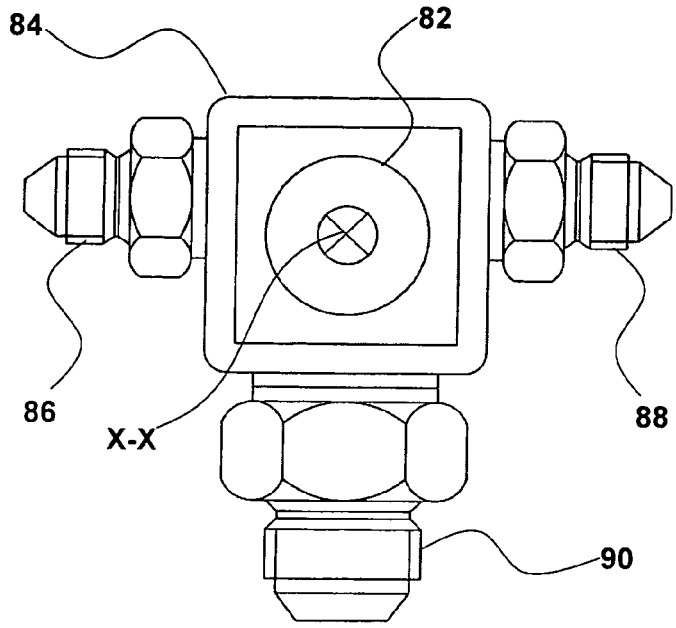
FIG. 8*a* is a plan view of a rotary connector according to an embodiment of the invention.

The rotary connectors 70 will now be described in more detail with reference to FIGS. 8*a* and 8*b*, which show a plan view and front elevation, respectively, of the rotary connector used in the previously described embodiment. The rotary connector comprises a three-way hose connector, indicated generally by 80, rotatably mounted on a ring bearing 82. The general configuration may be seen in FIG. 4, which shows the ring bearing extending through mounting bracket 40 to bear within the second mounting bracket 42.

The three-way hose connector comprises a generally cube shaped hollow body portion 84 with first and second male hose connectors, 86 and 88, on opposing faces of the cube 84, and a third male hose connector 90 on a third side of the cube 84. The ring bearing 82 is rotatably mounted on the side of the cube 84 which is adjacent to the three male hose connectors 86, 88, 90. It can therefore be appreciated that the three-way hose connector 80 is free to rotate about the X-axis X-X.

Figure 8B:
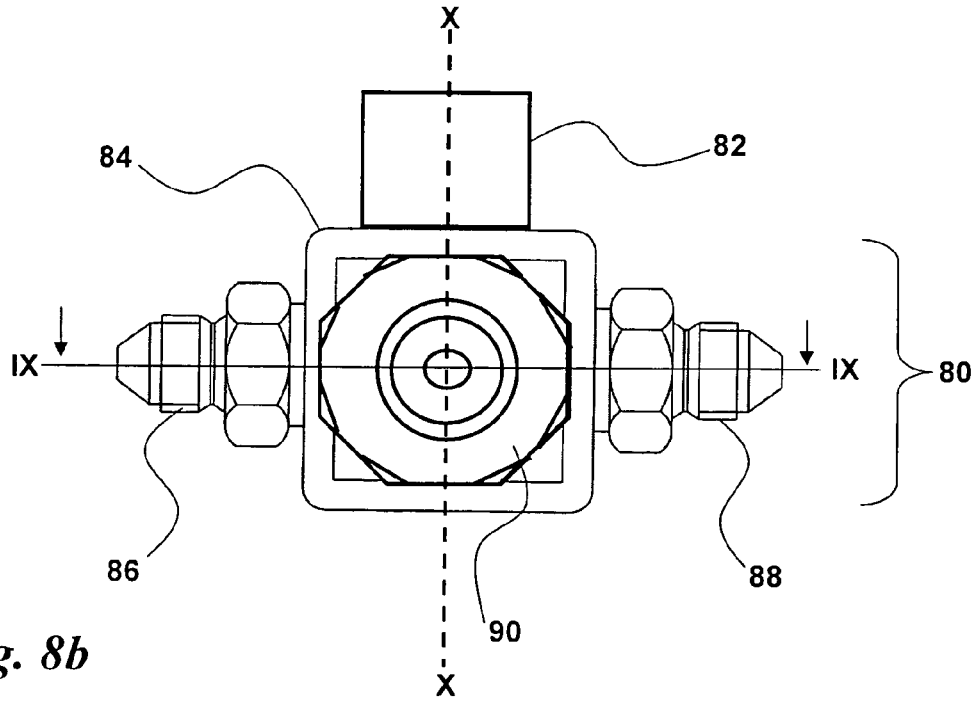
FIG. 8*b* is a front elevation of a rotary connector according to an embodiment of the invention.
Figure 9:
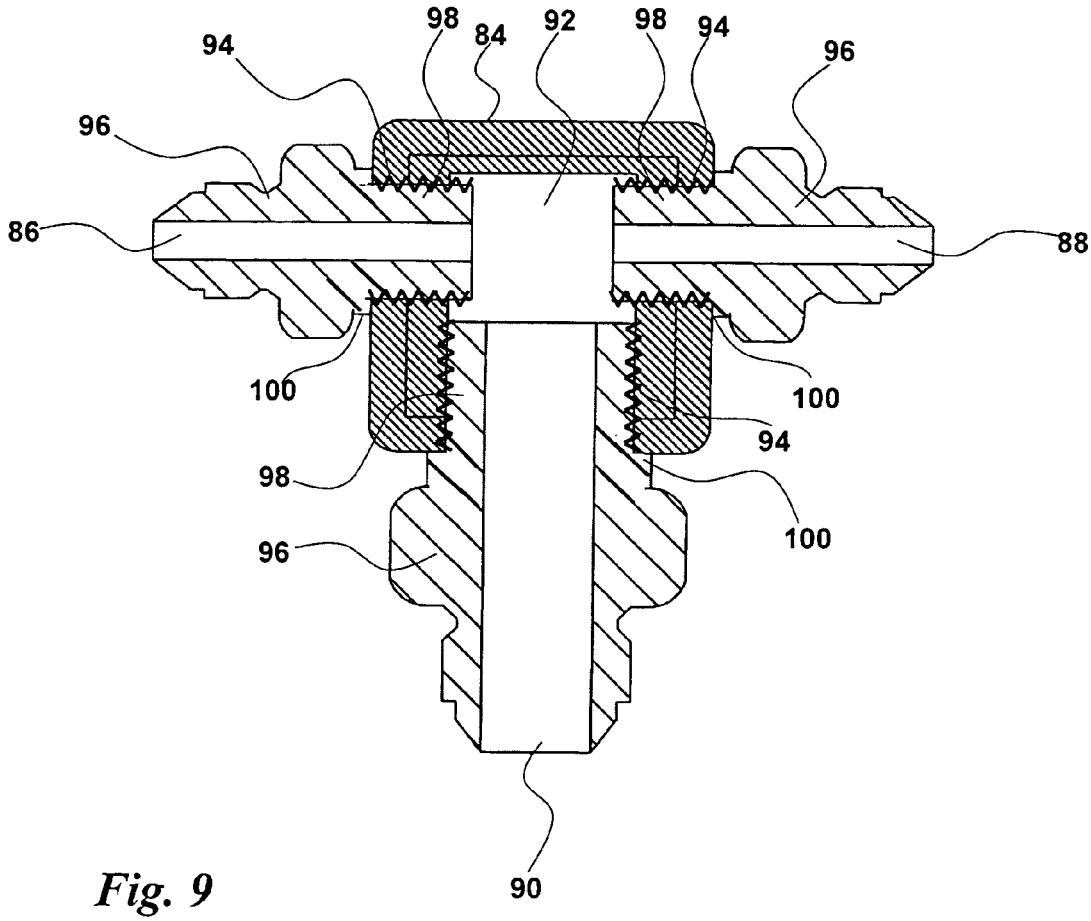
FIG. 9 is a longitudinal cross-section on the line IX-IX of FIG. 8.

Referring to FIG. 9, a longitudinal cross-section on the line IX-IX of FIG. 8*b* is shown. The rotary connector 70 comprises a generally cube shaped hollow body portion 84 defining a cavity 92 and having first to third female threaded portions 94 into which first to third male hosing connectors 86, 88, 90 are received. First, second and third male hosing connectors 86, 88, 90 each comprise a tubular body portion 96 of a first diameter, and a male threaded tubular portion 98 of lesser diameter at the cube connecting end of the connector. The junction between the body portion 94 and the threaded portion 98 forms an annular seat 100 which bears against the cube shaped body portion 84 when the connectors and body portion are screwed together.

Thus, the cube shape body portion 84 and the first to third male hosing connectors 86, 88, 90 form a T or Y-shaped joint for effecting connection between hydraulic hosing. This three-way hose connector 80 is also rotatable about an axis due attachment of the ring bearing 82 on a side of the cube shaped body portion 84 that is adjacent to the three male hose connectors 86, 88, 90.

The illustrated embodiment of the rotary connector comprises a typical three-way connector. It is therefore to be understood that a rotary connector according to alternative embodiments of the invention need not comprise a three-way hose connector, but instead may comprise a connector with any suitable number of connectors, male and/or female.

It will be noted that the three-way connector allows all three hoses to be within the first mounting bracket. This gives a very distinct advantage since there is no risk that the hose end fitted over the connector comes into contact with the boat damaging the paintwork.

Referring to 10*a*and 10*b*, a plan view and front elevation of a rotary connector according to an alternative embodiment of the invention are shown, respectively.

The rotary connector comprises a two-way hose connector, indicated generally by 102, rotatably mounted on a combined ring bearing 104 and third male hose connector 106 arrangement. The two-way hose connector comprises a generally cube shaped hollow body portion 108 with first and second male hose connectors, 110 and 112, on opposing faces of the cube body portion 108. The ring bearing 104 is rotatably connected to a side of the cube shaped body portion 108. The outer bearing surface 114 cooperates with the cube shaped body potion 108 such that the body portion 108 is free to rotate about the X-axis X-X with respect to the third male hose connector 106 that is attached to an inner bearing surface (not visible).

Figure 10A:
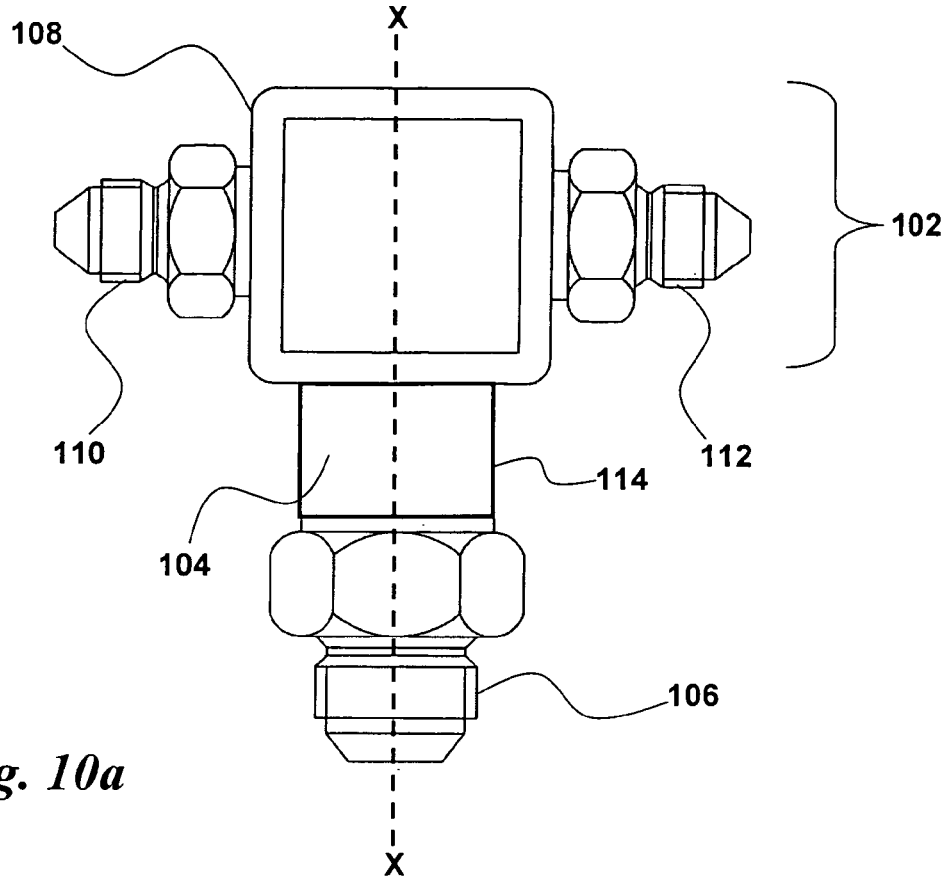
FIG. 10*a* is a plan view of a rotary connector according to another embodiment of the invention.
Figure 10B:
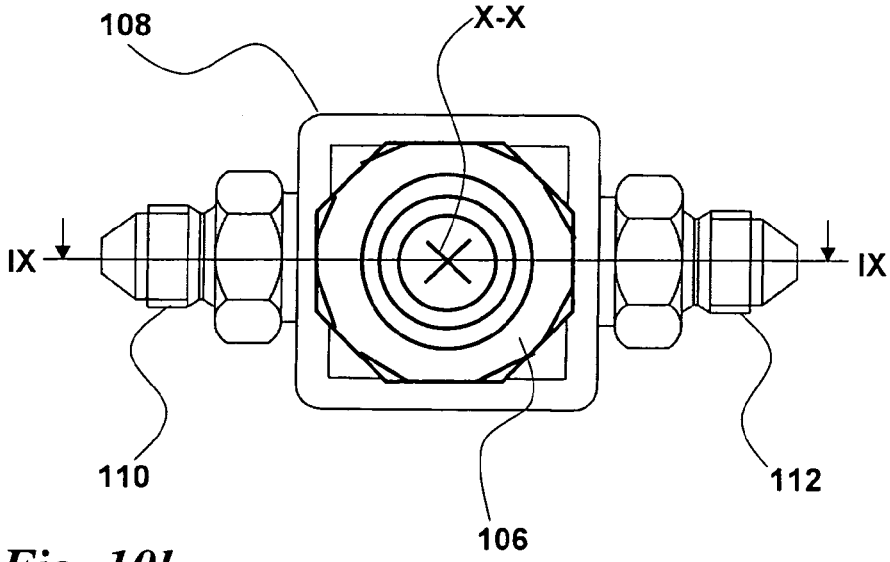
FIG. 10*b* is a front elevation of a rotary connector according to another embodiment of the invention.
Figure 11:
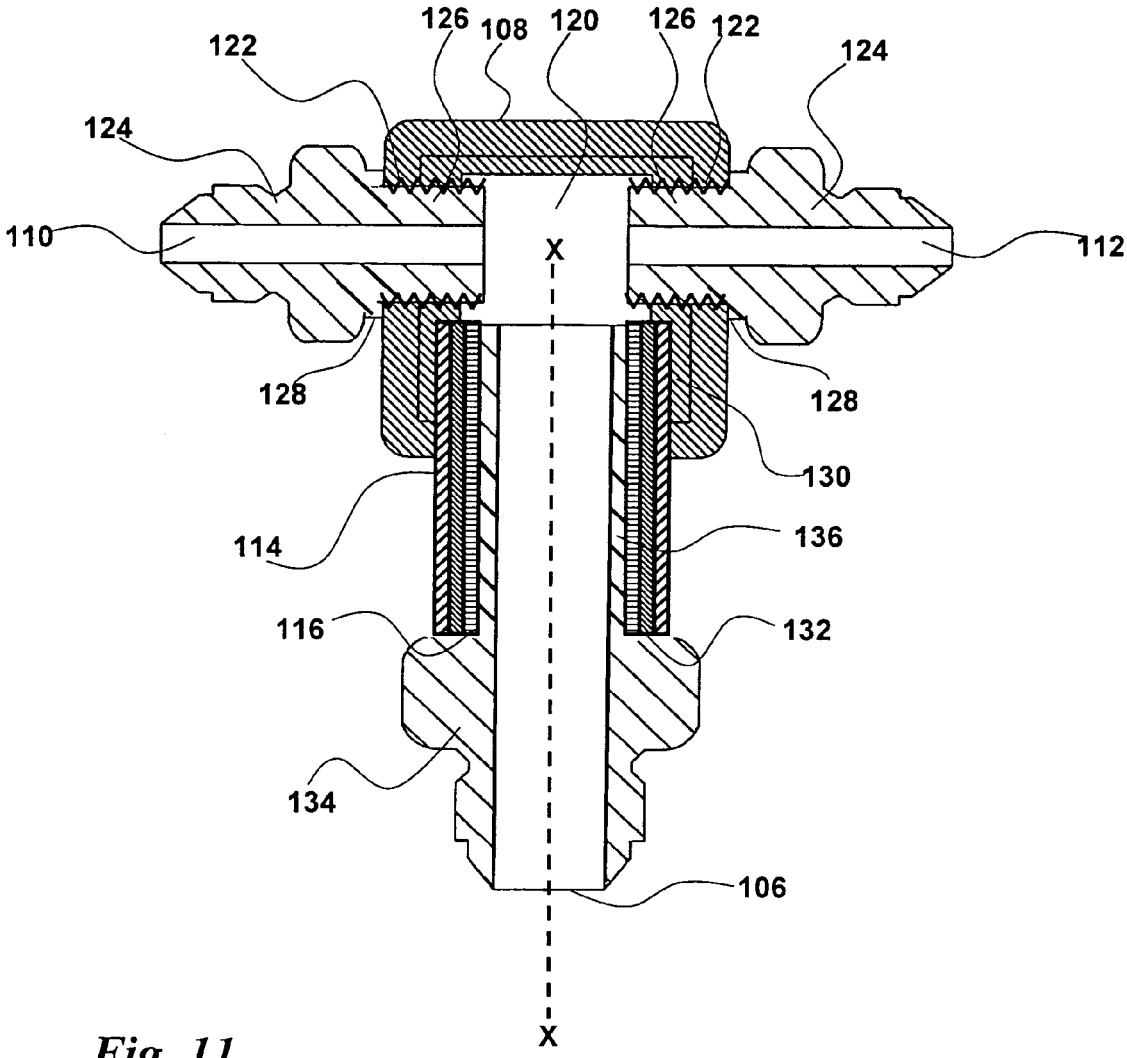
FIG. 11 shows a longitudinal cross-section on the line XI-XI of FIG. 10*b;*

Referring to FIG. 11, a longitudinal cross-section on the line XI-XI of FIG. 10*b* is shown. The rotary connector comprises a generally cube shaped hollow body portion 108 defining a cavity 120 and having first and second female threaded portions 122 into which first and second male hosing connectors 110, 112 are received. First, and second hosing connectors 110, 112 each comprise a tubular body portion 124 of a first diameter, and a male threaded tubular portion 126 of lesser diameter at the cube connecting end of the connector. The junction between the body portion 124 and the threaded portion 126 forms an annular seat 128 which bears against the cube shaped body portion 108 when the connectors 110, 112 and body portion 108 are screwed together.

The cube shaped hollow body portion 108 also has a bore 130 in one of its sides to receive and cooperate with an outer bearing surface 114. The ring bearing functions as would be generally expected by the skilled reader, rolling elements 132 being situated between the outer bearing surface 114 and an inner bearing surface 116 and enabling the outer bearing surface 114 to rotate freely about the X-axis X-X with respect to the inner bearing surface.

A third hosing connector 106 comprises a tubular bearing connecting body portion 134 connected to the inner bearing surface 116 and a hose connecting body portion 136. Thus, the third hosing connector 116 may rotate freely about the X-axis X-X with respect to the inner bearing surface 116 and the generally cube shaped hollow body portion 108 of the rotary connector.

It is to be appreciated that the rotary connector detailed above forms a T or Y-shaped joint for effecting a rotary connection between hydraulic hosing. This rotary connector enables two hosing connections to rotate about an axis with respect to a third hosing connection.

This rotary connector 70 enables an external hosing connection to be made with the rotary connector 70, the hosing connection being centred about the X-axis which minimises any unbalancing effects caused by such an external attachment. An external hose 73 can therefore be connected to the internal hose connections 71 connected between the internal hose connectors and the respective ports 72 on the drive means 38, the internal connections still being able to rotate about the X-axis X-X with the brush and drive means 38.

As above, it is to be appreciated that any suitable number of connectors, male and/or female, may be employed in alternative embodiments of the rotary connector illustrated above. In addition, although the above embodiments have been detailed with respect to connectors for hydraulic hosing, alternative embodiments may comprise connectors for alternative connection types, such as wire or pneumatic connections.

Figure 12A:
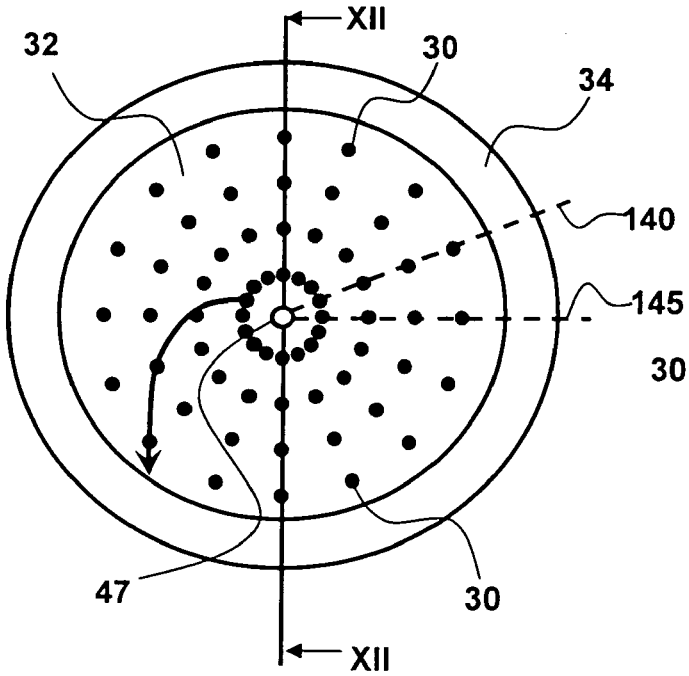
FIG. 12*a* shows a front elevation of a brush according to an embodiment of the invention.
Figure 12B:
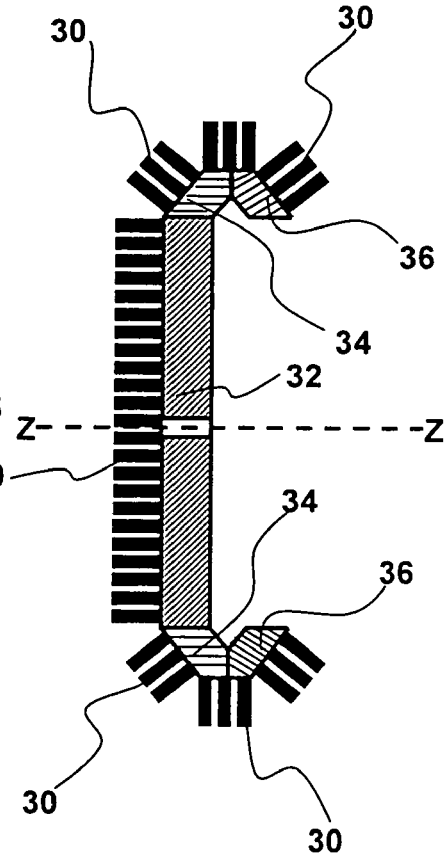
FIG. 12*b* shows a vertical cross-section on the line XII-XII of FIG. 12*a;*

FIGS. 12*a* shows a front elevation of a brush according to an embodiment of the invention. FIG. 12*b* shows a vertical cross-section on the line XII-XII.

The brush comprises bristles 30 attached to a flat front circular surface 32, to a tapered outer front surface 34, and to a tapered outer rear surface 36. Note that, for the purpose of clarity, the bristles 30 attached the tapered outer front surface 34 are not shown in FIG. 12*a*

As described above, hydraulic drive means (not illustrated) are operative to rotate the brush about a Z-axis Z-Z. The Z-axis Z-Z intersects the flat front circular surface 32 at a point pivot point 47 which is substantially in the centre of the flat front circular surface 32. The Z-axis is also arranged such that it is substantially perpendicular to a directional plane within which the front surface 32 generally extends.

Although the provision of hydraulic drive means to rotate the brush has been detailed, it will also be appreciated that rotation of the brush may be provided using any suitable arranged drive means, for example a rotating motor.

The bristles 30 attached to the flat front circular surface 32 are arranged in rows of bristle clumps extending radially from the central pivot point 47 of the brush. Consequently, the space between corresponding bristle clumps in adjacent rows increase with the radial distance of the bristle clumps from the pivot 47. This spacing is indicated generally by dashed lines 140 and 145.

This arrangement combines the effect of centrifugal force with support for wave motion between the bristle clumps to steer foreign matter outwardly from the centre of the brush as the brush rotates. The feature of wave motion may be explained with reference to FIG. 12*a*, wherein an ejection path of foreign matter as the brush rotates in a clockwise direction is in illustrated by arrow R. As the brush rotates, foreign matter displaced by an inner bristle clump is forced outwards from the centre of the brush due to centrifugal. However, the clockwise rotation of the brush face results in the foreign matter moving towards a trailing row of bristle clumps which then displaces the foreign matter outwardly as before. Thus, the foreign matter follows a wavelike path around the face, outwardly towards the edge of the brush whereby it is ejected from the brush face.

It may also be appreciated that the layout of bristle clumps caters for clockwise and anti-clockwise rotation of the brush.

The brush according the present invention therefore allows foreign material to pass through channels formed between the bristle clumps 30, irrespective of the direction of rotation of the brush. Thus, there is provided a brush that is 'self-cleaning', the design of the bristle layout on the flat front surface 32 enabling foreign matter to be ejected due to the centrifugal force resultant from rotation of the brush and wave motion steering of the bristle clump arrangement.

It should be appreciated the flat front surface is not limited to being of circular shape and may be of any suitable shape. Similarly, although the bristles 30 are shown to be of equal length, the bristles may be of differing lengths. For example, the bristles 30 attached to the tapered outer rear surface 36 may be of a length such that all of the bristles 30 attached to the brush extend the same orthogonal distance from the plane of the flat front circular surface 32.

Figure 13A:
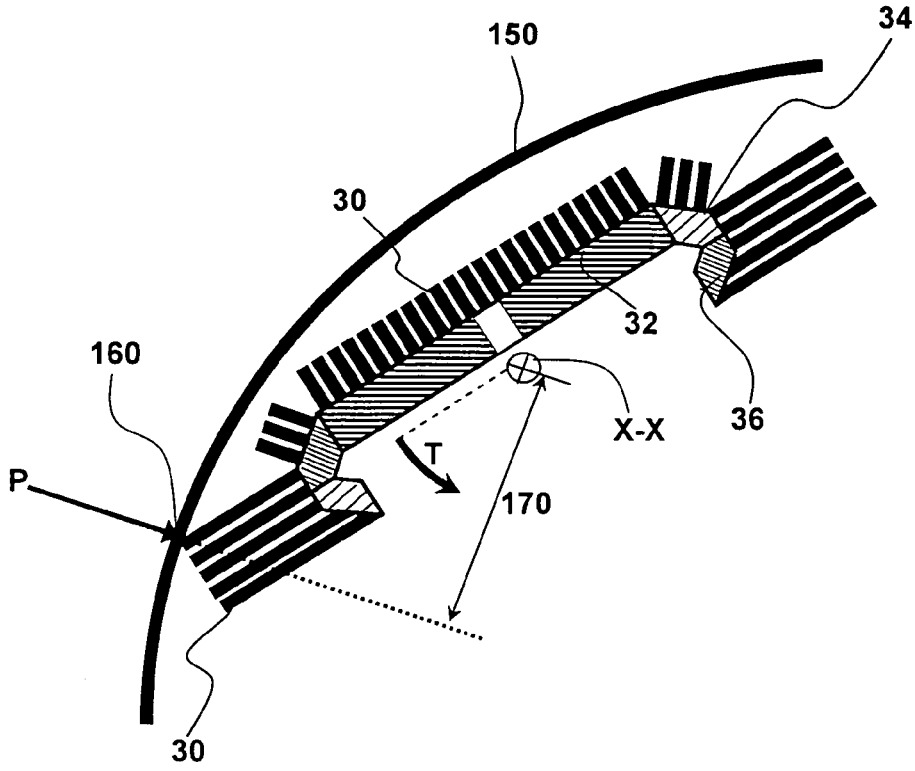
FIG. 13*a* is an illustration of a brush shown in FIG. 12 cooperating with a curved surface to be cleaned, the brush being shown as an alternative vertical cross-section along the line XII-XII of FIG. 12*a;*

The operation of a brush arrangement according to an embodiment of the invention will now be described with reference to FIG. 13*a*. FIG. 13*a* is an illustration of a brush shown in FIG. 12 cooperating with a curved surface 150 to be cleaned, the brush being shown as an alternative vertical cross-section along the line XII-XII of FIG. 12*a*.

The bristles 30 attached to the tapered outer front and rear surfaces 34 and 36 are of a greater length than the bristles 30 attached to the flat front surface 32 and extend generally radially from the centre of the brush face in the same directional plane as the flat front surface 32 of the brush.

Similarly to previously described embodiments of a brush and gimbal arrangement, the brush is rotatably supported by supporting means (not shown) such that the brush is free to rotate about an X-axis X-X. It is preferable that the X-axis X-X is arranged a gap distance away from the back of the flat front surface 32 of the brush, the arrangement being less preferable as the distance between the X-axis X-X and back of the flat front surface 32 is increased.

If the brush is operative to clean a curved surface 150, after some motion the bristles attached to the flat front surface 32 of the brush will not be in contact with the curved surface 150 to be cleaned although the bristles attached to the tapered outer front and rear surfaces 34 and 36 do come into contact with the curved surface 150.

As the bristles attached to the tapered outer front and rear surfaces 34 and 36 come into contact with the curved surface 150 to be cleaned, a force P perpendicular to the surface at the point of contact 160 is experienced by the bristles 30 and the brush. Force P is perpendicular distance 170 from the axis of rotation X-X of the brush. Thus, there is created a moment (whereby the term 'moment' refers to a turning force about a pivot) about the X-axis X-X of rotation that causes rotational movement of the brush about the X-axis X-X, indicated generally by arc T.

It may therefore be appreciated that the brush is manipulated by the turning force P to rotate about the X-axis such that bristles 30 attached to the flat front surface 32 of the brush regain contact with the curved surface 150 to be cleaned. In other words, the brush is steered such that bristles 30 attached to the flat front surface 32 maintain It may be appreciated from the description above that bristles attached to the tapered outer front and rear surfaces 34 and 36 are to be selected and/or arranged such that they have enough body or stiffness to withstand the turning force P to such a degree that a the rotational movement of the brush about the X-axis X-X is created without the curved surface coming into actual contact with any of the surfaces 32, 34, 36 of the brush. However, it is to be appreciated that by minimising any forces resistive to the rotational movement of the brush about the X-axis X-X, the required body or stiffness of the bristles attached to the tapered outer front and rear surfaces 34 and 36 may be reduced to a minimised. For example, use of bearing to pivot the brush about the X-axis X-X will help to minimise the frictional forces.

In the described embodiment, the brush is also rotatably supported such that the brush is free to rotate about the Y-axis which intersects the X-axis X-X and is substantially perpendicular to the X-axis X-X. The flat front surface 32 of the brush may thus maintain contact with a surface such as a boat hull, for example.

It has been appreciated by the applicant that if the brush is driven to rotate about a Z-axis Z-Z such as that illustrated in FIG. 12, operating the brush within a viscous or liquid environment results in substantial resistive forces being experienced by the brush that act against the rotational movement of the brush. Thus, it is desirable to reduce the power requirements imposed on drive means that are operative to rotate the brush in such environments.

A typical approach to reduce the drive requirements is to reduce the speed of rotation of the brush. However, using hydraulics it is necessary to operate the motors at speed in order to lubricate the bearings. Typically, the brush is rotated at a speed in the range of 10 rpm-200 rpm.

Figure 13B:
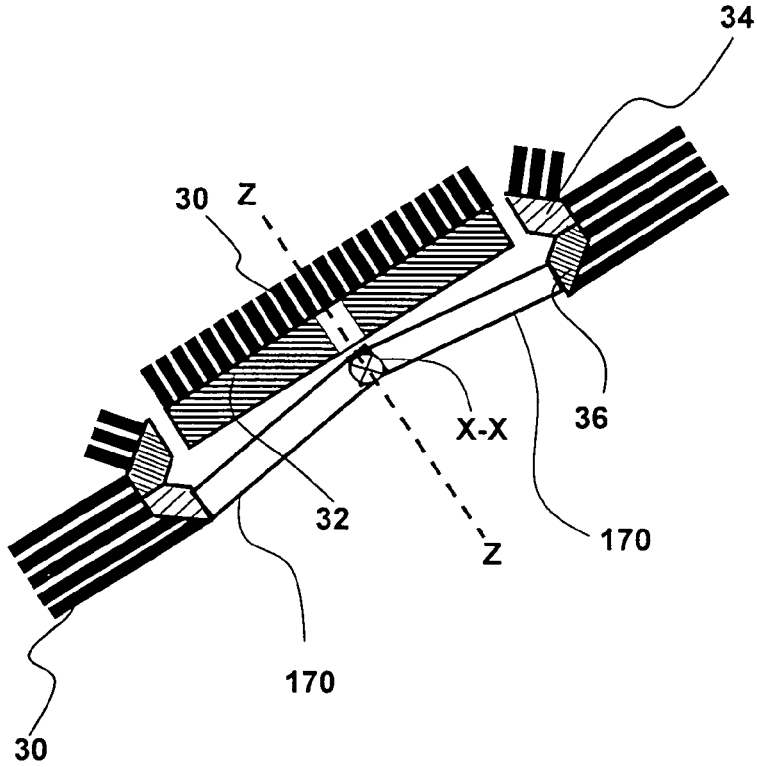
FIG. 13*b* shows an alternative embodiment of a brush, the brush being shown as an alternative vertical cross-section along the line XII-XII of FIG. 12*a;*

FIG. 13*b* is an alternative embodiment of a brush, the brush being shown as an alternative vertical cross-section along the line XII-XII of FIG. 12*a*.

Accordingly, in this alternative embodiment, in order to provide a rotary brush with the steering features of the embodiments while minimising the drive requirements, the flat front surface 32 of the brush may rotate about the Z-axis while the tapered outer front and rear surfaces 34 and 36 remain static and do not rotate about the Z-axis.

The tapered outer surfaces 34 and 36 of the brush are separated from the front surface 32 of the brush and attached to support arms 170. The support arms 170 are arranged such that the tapered outer surfaces 34 and 36 of the brush are free to rotate about the X and Y axes similarly to the previous embodiment. However, unlike the front surface 32 of the brush, they are not driven to rotate about the Z-axis Z-Z.

Thus, maximum power from the drive means can be used to rotate the flat front surface 32 of the bush, thereby removing a substantial amount of drag forces that would otherwise be created by the rotation of the tapered outer front and rear surfaces 34 and 36.

Such an alternative arrangement may still provide the steering function of the brush according to the general concept illustrated in FIG. 13 and described above. However, the bristles attached to the outer front and rear surfaces 34 and 36 may be replaced with skid pads or rollers, or any other suitable means that would provide a turning moment for the brush, while also protecting the surface to be cleaned from contact with the brush surfaces.

In another alternative embodiment, fluid is supplied to the front surface 32 of the brush from behind as it rotates about the Z-axis Z-Z. For example, such fluid could comprise a cleaning agent or an anti-fouling agent. To avoid the need for an additional attachment to the brush to supply such fluid as it rotates, the fluid is provided internally of the axle (not shown) upon which the brush rotates about the Z-axis. The provision of the fluid may come from an internal connection between a rotary connector 70 and the drive means 38. Alternatively, the fluid may be provided via an external connection to axle.

Embodiments of the invention therefore provide a brush arrangement, whereby the brush is rotatably supported and the brush comprises cleaning means attached to a rear and/or side of the brush such that when the cleaning means come into contact with a surface, there is created a moment that results in rotational movement of the brush.

Figure 14B:
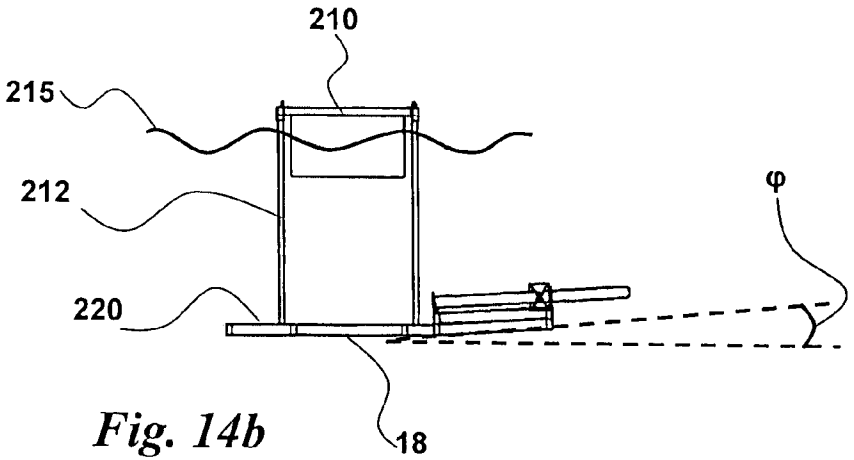
FIG. 14*b* is a side elevation of a boat cleaning assembly according to an embodiment of the invention.
Figure 14A:
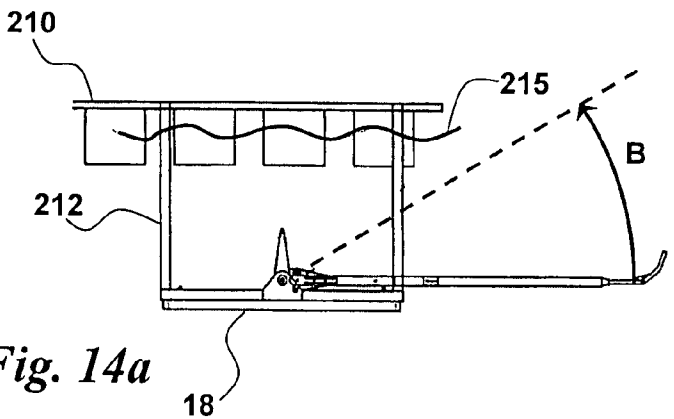
FIG. 14*a* is a front elevation of a boat cleaning assembly according to an embodiment of the invention.
Figure 14C:
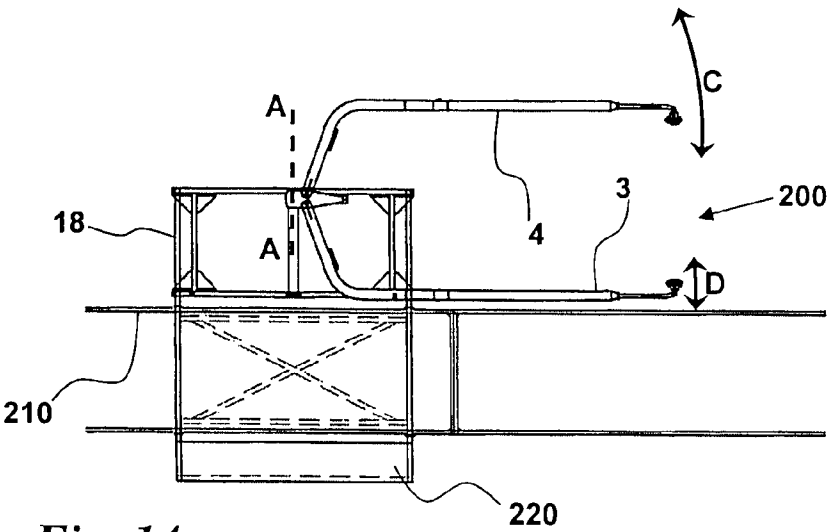
FIG. 14*c* is a plan view of a boat cleaning assembly according to an embodiment of the invention.

Referring to FIGS. 14*a*, 14*b* and 14*c*, the complete boat cleaning assembly 200 incorporating the above improvements over that of FIGS. 1 and 2 is shown in front elevation, side elevation, and plan view, respectively.

The assembly 200 is shown submerged in a suitable region of water, attached to a floating mooring pontoon 210. The assembly includes a mounting frame 212 to attach the assembly to the mooring pontoon 210 so that the base framework 18 is above the sea bed. Alternatively, if the region of water is not of substantial depth, the base framework 18 may rest on a sea bed. The pontoon may be a pontoon specifically designed for the boat cleaning assembly or alternatively it may be a pontoon already in place. In other embodiments, the assembly may be mounted on a fixed mooring.

The assembly 200 is arranged such that long arms 3 and 4 extend in the initial position generally in the longitudinal direction of the mooring 210 and are positioned one side of the mooring 210. The arm closest to the mooring 210 is hereafter referred to as the inner arm 3 and the arm furthest away from the mooring 210 is hereafter referred to as the outer arm 4.

A brush and gimbal arrangement as described above is fixed to the end of each of the inner and outer arms. The second arm portion 46 is directly fixed to each long arm 3, 4, extending in the same direction. A brush 31 is fixed to first and second mounting brackets 40, 42 and by first arm 44 to the second arm, to allow motion as described with reference to FIGS. 3 to 6.

The assembly 200 further comprises a counter balance 220 attached to the side of the base framework 18 which is opposite to the side on which the arms 3 and 4 are positioned. The counter balance is simply a piece of material of any suitable size, shape and mass such that that the weight of the assembly 200 is substantially balanced about the mooring 210.

To clean a marine vessel, it is positioned above the arms 3, 4 and moved along the mooring in the longitudinal direction. Drive means (not visible) are operable to repeatedly pivot the arms 3, 4 outwardly, upwardly and then inwardly so that brushes 5 and 6 contact the hull. The brushes are then moved up and down to clean the hull of the vessel. The vessel is slowly moved forward so that the arms clean the whole length of the vessel.

However, with the mounting frame 212 attached to the pontoon 210 such that base framework 18 and the A-axis A-A is arranged substantially horizontal, the lateral travel of the inner arm 3 along arc D is restricted by the edge of the mooring pontoon 210. The outer arm 4 can move more freely. Since the lateral movement of the outer arm 4 describes an arc C, the outer arm 4 falls lower than the inner arm 3 when at the maximum beam of the vessel being cleaned (when the arms 3, 4 are rotated about axis A-A to the top of the vertical arc B). This effect increases as the depth of the assembly 200 and the distance travelled by the arms 3, 4 to reach the surface of the water 215 is increased.

To compensate for the imbalance in vertical movement of the inner and outer arms, the mounting frame 212 is arranged such that, when the assembly 200 is attached to the pontoon 210, the A-axis A-A, about which the arms 3, 4 turn, is tilted upwards from horizontal so that the outer arm 4 is higher than the inner arm 3. The angle of tilt may be referred to as the angle between the horizontal and plane passing through the two arms 3, 4 in their rest position, and is indicated in FIG. 14*b* by the angle $\phi$.

Investigations by the applicant have shown that the angle of tilt required to compensate may be optimised with respect to the depth of the base framework 18, whereby the angle of tilt should be increased approximately 2° (two-degrees) for every 2 m (two-meters) of vertical depth below the surface of the water 215 the base framework 18 is submersed. In alternative embodiments of the invention, the arms 3 and 4 will be of greater length so that the required pivotal range of movement about the A-axis A-A for the arms to reach the surface of the water 215 is reduced. By increasing the radius of the vertical arc B swept out by the arms 3 and 4 as they rotate about axis A A-A, thereby minimising the required pivotal range of motion, the vertical arc B swept out by arms 3 and 4 tends towards an approximation of a vertical line.

Figure 15:
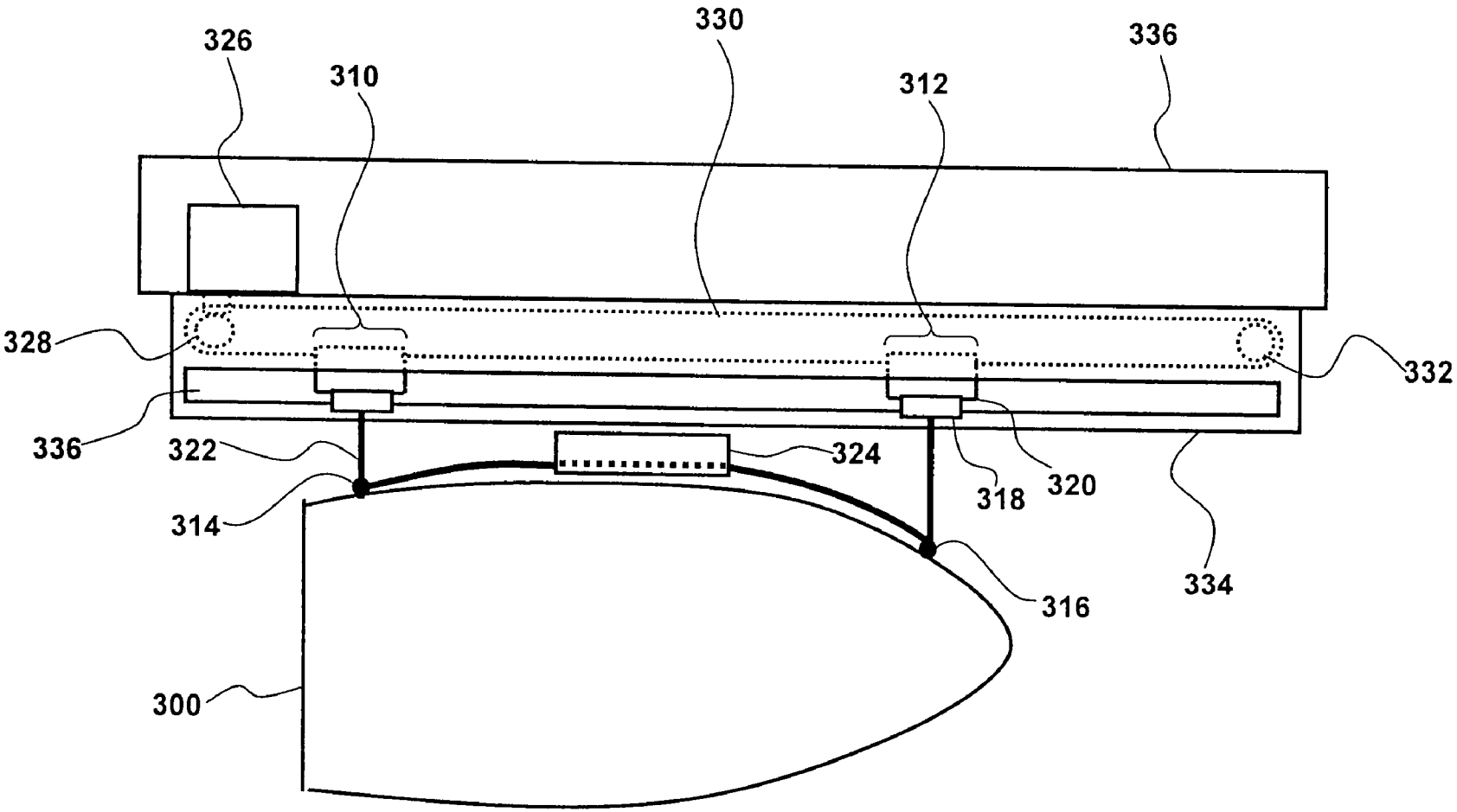
FIG. 15 is a plan view of an apparatus for manoeuvring a floating boat according to an embodiment of the invention.

It will be appreciated that the arrangement requires the boat to be driven slowly forwards. Referring to FIG. 15, a plan view of an apparatus for manoeuvring a floating boat 300 according to an embodiment of the invention is illustrated. Dotted lines indicated internal features that would not otherwise be visible. The apparatus comprises first and attachment means and bi-directional drive means. The attachment means is arranged such that it is connected to first and second places 314 and 316 on the boat 300, first and second places 314, 316 being longitudinally spaced apart. The attachment means is releasably coupled to the bi-directional drive means so that the apparatus is operable to move the boat in either of two opposing directions, the opposing directions being in a generally longitudinal direction.

The attachment means is connected to first and second travellers 310 and 312 that each comprise connection means 318 and coupling means 320, the coupling means 320 being operable to couple the respective traveller to the drive means.

The connection means comprises a cable 322. One end of a cable 322 is attached to the connections means 318 of the first traveller 310 and connected to the first place 314 on the boat 300. The other end of the cable 322 is attached to the connections means 318 of the second traveller 310 and connected to the second places 316 on the boat 300. The cable is also arranged such that it runs internally through protection means 324.

The bi-directional drive means includes a bi-directional motor 326 that is operable to drive winching means 328. The bidirectional drive means further comprises a chain 330 that cooperates with the wincing means 328 and a pulley block 332 such that the chain 330 may undergo bi-directional movement between the winching means 328 and the pulley block 332. The drive means also comprises a housing 334 within which the winching means 328, chain 330 and pulley block 332 are enclosed, the winching means 328 and the pulley block 332 being fixed at opposing ends of the housing 334. The housing 334 and bi-directional motor 326 are attached to a mooring 336 such that they remain fixed in relation the mooring 336.

The housing 334 also comprises an opening 336 in its top surface that extends substantially in the same direction as the chain 330 between the winching means 328 and the pulley block 332.

The first and second travellers 310 and 312 are coupled to the chain through the opening 336 of the housing 334 such that their coupling means 320 are within the housing 334 and their connection means 318 protrude vertically through the opening so that a portion of their connection means is outside of the housing 334. Preferably, the first and second travellers 310 and 312 are also arranged such that their longitudinal separation is generally the same as the longitudinal separation of the first and second places 314 and 316 on the boat 300.

The coupling means 320 comprises a releasable clutch mechanism that functions to allow its associated traveller 310 or 312 to be freely manoeuvred back and forth along the chain 330. Once a desired position of the attachment means on the chain 330 is obtained, the clutch mechanism is operated to fixedly couple the attachment means to the chain so that it does not move relative to the chain 330. The clutch mechanism may also be released so that its associated traveller 310 or 312 can be repositioned as necessary.

The tension in the cable 322 is increased such that the boat 300 is pulled towards the first and second travellers 310, 312. The tension is increased to a value that causes the cable between the first and second places 314 and 316 on the boat 300 to be urged against the side of the boat 300 and the boat 300 to be urged against the housing 334 of the drive means. Thus, it may be appreciated that the protection means 324 should be arranged such that it is placed between the side of the boat 300 and the housing 334 at the place on the side of the boat 300 that would otherwise make contact with the housing 334 as it is urged against the housing 334.

It is to be appreciated that the tension in the cable may be controlled such that the pressure exerted by the boat 300 on the protective means is maintained at a predetermined value. In this way, the boat 300 and the housing 334 may be protected from experiencing excessive forces that may, for example, cause damage or increase the drive power requirements.

Once the tension in the cable has reached the required value, the drive means are operated such that chain 330 undergoes movement that causes the first and second travellers 310 and 312 to undergo the same movement. Thus, it may be appreciated that the boat 300 is moved in the same general direction as the travellers 310, 312 due to the boat's 300 connection with the travellers 310, 312.

Thus, the bi-directional drive allows for the boat 300 to be manoeuvred relative to the fixed portion of the drive means in either of two opposing directions.

An apparatus for manoeuvring a floating boat thus comprises attachment means adapted for attachment to different places on the boat, and bi-directional drive means. The attachment means is coupled to the drive means so that the apparatus is operable to move the boat in either of two opposing directions.

Although the preferred embodiment of the invention uses the chain drive means set out above it is also possible to use the boat cleaning apparatus with other more conventional means to move the boat backwards and forwards such as a winch and rope.

In an alternative approach, the boat cleaning assembly may be moved forward leaving the boat stationary. In this alternative, the boat cleaning assembly may be winched forward using a winch and rope or indeed the chain drive as set out above.

Alternative arrangements may further comprise control means such arranged such that the drive means is programmable or controllable.

Furthermore, other embodiments of the invention may also cooperate with boat cleaning assemblies, such as those detailed above, so that boat manoeuvring apparatus and boat cleaning assembly are controlled together. In such examples, the drive means of the boat manoeuvring apparatus may be operated as the arms of the associated cleaning assembly are raised through their vertical cleaning arc. By controlling the movement such the boat is moved to compensate the curved shape of the arc, the boat may be cleaned in straight vertical strokes instead of arc-shaped strokes.

The embodiments described refer to the vessel being cleaned as a boat or as a floating vessel. These terms are intended to include all forms of floating vessel, including for example ships, yachts, submarines, dinghies, barges and narrowboats, used both on sea and on inland waterways.

Those skilled in the art will realise that the above embodiments are purely by way of example and that modification and alterations are numerous and may be made while retaining the teachings of the invention.

I claim:

1. An arm arrangement for cleaning a surface of a floating vessel, comprising:

an arm;

a brush and gimbal arrangement on the end of the arm, the brush and gimbal arrangement including:

a brush;

a drive connected to the brush for rotating the brush about a first axis;

pivots to allow the brush and drive means to freely rotate about a second axis substantially perpendicular to the first axis and to freely rotate about a third axis substantially perpendicular to the first and second axes to allow the brush to pivot on the end of the arm to follow the surface for cleaning, wherein the brush and drive means are fixed to a first mounting bracket pivoted to a second mounting bracket about the second axis, and wherein the brush and drive means are spaced along the first axis on opposite sides of the second axis.

2. An arm arrangement according to claim 1, wherein the arm further includes adjustment means for adjusting the position of the pivot of the first mounting bracket in the second mounting bracket along the first axis to balance the brush and drive means.

3. An arm arrangement according to claim 2, further comprising:

a three-way connector having opposed first and second hose connectors, a third hose connector in communication with the first and second hose connectors, and a bearing, the three-way connector being mounted with the bearing; and hoses connecting the first and second hose connectors to the drive means.

4. An arm arrangement according to claim 3, wherein the hose connectors are within the first mounting bracket.

5. An arm arrangement according to claim 2, further comprising a first arm portion, wherein the second mounting bracket is pivoted to the first arm portion around the third axis.

6. An arm arrangement according to claim 5 further comprising a second arm portion, wherein the first arm portion is pivoted to the second arm portion to allow motion about a fourth axis substantially parallel to the second axis and spaced from the second axis, and a fifth axis extending along the length of the second arm portion.

7. An arm arrangement according to claim 6 wherein the second arm portion is mounted on the end of the arm and extends in the longitudinal direction of the arm.

8. An arm arrangement according to claim 7, wherein the brush has an inner front face and an outer front face, wherein the inner front face rotates about the first axis and the outer front face does not rotate about the first axis.

9. An arm arrangement according to claim 8 wherein the brush has a substantially flat front face supporting a plurality of cleaning means, the cleaning means being arranged in rows extending radially from the first axis about which the brush rotates.

10. An arm arrangement according to claim 9 wherein the cleaning means are bristle clumps or cleaning pads.

11. An arm arrangement according to claim 1 wherein the brush has a flat front face and guide means arranged around the flat front face to guide the brush over the surface.

12. An arm arrangement according to claim 1 wherein the brush is in fluid communication with the drive means.

13. A cleaning assembly for cleaning a floating vessel, comprising:

a submersible framework;

means for mounting the submersible framework to a fixed body; and two arm arrangements according claim 1, each arm being pivoted to the submersible framework at the opposite end of the arm to the brush and gimbal arrangement, the arms being pivoted to allow the arms to move to move the brush to clean both sides of the floating vessel, arranged such that when the assembly is mounted the arms have a substantially horizontal rest position.

14. A cleaning assembly according to claim 13 wherein the first and second arms rotate about a common substantially lateral axis on the submersible framework substantially perpendicular to the length of the arms, wherein the mounting means is arranged such that the rest position of the lateral axis is tilted at an angle of 0.1° to 10° from the horizontal so that the one of the arms is slightly raised above the other of the arms.

15. A cleaning assembly according to claim 13, further comprising a boat drive for moving the floating vessel forward and aft in the longitudinal direction;

bidirectional drive means having a plurality of longitudinally spaced drive positions; and attachment means adapted to attach a plurality of different places on the floating vessel to respective drive positions;

wherein the bidirectional drive means is arranged to drive the plurality of longitudinally spaced drive positions together to move the floating vessel fore and aft.

* * * * *